United States Patent [19]

Joraku et al.

[11] 4,087,078

[45] May 2, 1978

[54] MOVING APPARATUS FOR A LOAD

[75] Inventors: Masami Joraku; Koji Yamauchi, both of Hitachi; Shigeyoshi Kawano, Hitachiota; Masahiro Ueno, Hitachi, all of Japan

[73] Assignee: Hitachi, Ltd., Japan

[21] Appl. No.: 677,059

[22] Filed: Apr. 14, 1976

[51] Int. Cl.[2] ..... B66D 1/48

[52] U.S. Cl. ..... 254/173 R; 318/374

[58] Field of Search ..... 254/173 R, 168, 187 G; 318/371, 374; 188/181 R, 181 C; 303/95; 180/105 E, 82 R; 361/236, 239; 192/.033, 3 H

[56] References Cited

U.S. PATENT DOCUMENTS

| | | | |
|---|---|---|---|
| 2,426,029 | 8/1947 | Kuhn | 318/374 |
| 2,503,438 | 4/1950 | Gruner | 318/374 |
| 2,514,896 | 7/1950 | Noodleman | 318/374 |
| 2,625,672 | 1/1953 | Calvert | 318/374 |
| 3,365,614 | 1/1968 | Luongo et al. | 303/95 |
| 3,417,289 | 12/1968 | Jensen | 361/236 |
| 3,516,526 | 6/1970 | Seesselberg | 188/158 |
| 3,735,224 | 5/1973 | Bachofer et al. | 318/374 |
| 3,774,095 | 11/1973 | Coccia | 318/371 |
| 3,852,616 | 12/1974 | Carp et al. | 303/95 |

*Primary Examiner*—Trygve M. Blix
*Assistant Examiner*—Kenneth Noland
*Attorney, Agent, or Firm*—Craig & Antonelli

[57] ABSTRACT

A moving apparatus for a load lifts the load by the torque of a motor, and balances and holds the same with the aid of a mechanical brake when the apparatus stops. A timing device is incorporated in brake control so that when the apparatus stops in response to a signal indicating that a zero speed is designated, the mechanical brake is operated with a time lag after the receipt of the signal and, as soon as the brake is applied, the power supply to the motor is cut off. This arrangement remarkably reduces the impact of stopping upon the mechanical brake and drive, lessens the wear of the brake, permits reduction in size of the components and extends the service life of the components, thus providing an apparatus which saves power in comparison with conventional equipment.

1 Claim, 5 Drawing Figures

MOVING APPARATUS FOR A LOAD

BACKGROUND OF THE INVENTION

This invention relates to a moving apparatus for a load, and more particularly to such an apparatus capable of balancing the load by the torque of a motor.

An apparatus of this character has already been proposed by Applicant and is described in U.S. Pat. No. 3,841,605. The prior art apparatus permits the operator to use only a slight manual effort to handle a heavy load freely as if it were weightless. This operational advantage must be weighed, however, against the disadvantages of the necessity of an uninterrupted power supply to the motor and the use of highly complex control circuitry.

The continuous flow of current is undesirable because it can have adverse effects on the life of the motor and other electric components and circuits and accompanies an accordingly high power consumption.

A possible solution to this problem is to apply a mechanical brake to the lift drive and cut off the power supply to the motor while the load is being held in a suspended state in conformity with the zero-speed designation.

The mechanical brake is to be used need not be novel; it may be of any type commonly in use with electric hoists. The brake is taken off when a push button for lifting or lowering is pressed and is applied as soon as the button is released. This type of brake has the following shortcomings:

The timing relationship between the mechanical brake and motor when the apparatus is to be stopped is such that, in the process of stopping, the mechanical system including the motor and the load will continue to move by inertia and will not allow the actual speed of the apparatus to drop to zero as soon as a zero-speed signal is given. In other words, the apparatus will not stop at once. Nevertheless, the mechanical brake is applied instantaneously upon receipt of the zero-speed signal, and therefore the brake must absorb all the inertial energy of the mechanical system. Thus despite the speed control function with which it is provided, the apparatus is suddenly forced to a stop the moment the speed designation is set to zero. Consequently, the operability of the apparatus is seriously affected and the brake must be designed to have a more than necessary braking capacity in order to absorb the impact energy that is produced at each stop of the apparatus. In addition, the life of the brake is shortened.

On the other hand, it must also be noted that, in the case of an ordinary electric hoist, the power supply to the motor is cut off as soon as the push button is released and therefore it is highly dangerous if the mechanical brake fails to operate immediately. A slight delay in the timing for brake application would cause unintended fall of the load.

In the apparatus according to the above-mentioned prior U.S. Patent, the motor will continue to generate sufficient torque (servo-balanced) to hold the load in suspension even when the speed is set to zero. If in this case a mechanical brake is applied, it will no longer be necessary to hold the load by the torque of the motor and it will become possible to disconnect the motor from its power source.

SUMMARY OF THE INVENTION

It is a primary object of the present invention to provide a moving apparatus for a load, equipped with a mechanical brake and speed control means, wherein both the driving system including the motor and the mechanical brake are protected against excessive impact.

Another object of the invention is to provide a moving apparatus for a load designed to cut off the power supply in a well timed operation so as to achieve a saving of power consumption.

The foregoing objects of the invention are realized by an arrangement in which control means for the mechanical brake incorporates a timing device for actuating the brake with a lag behind the receipt of a motor-stop (zero-speed) signal and, simultaneously with the actuation of the mechanical brake, the power supply to the motor is cut off.

DETAILED DESCRIPTION OF THE PREFERRED EMBODIMENTS

Figure 1:
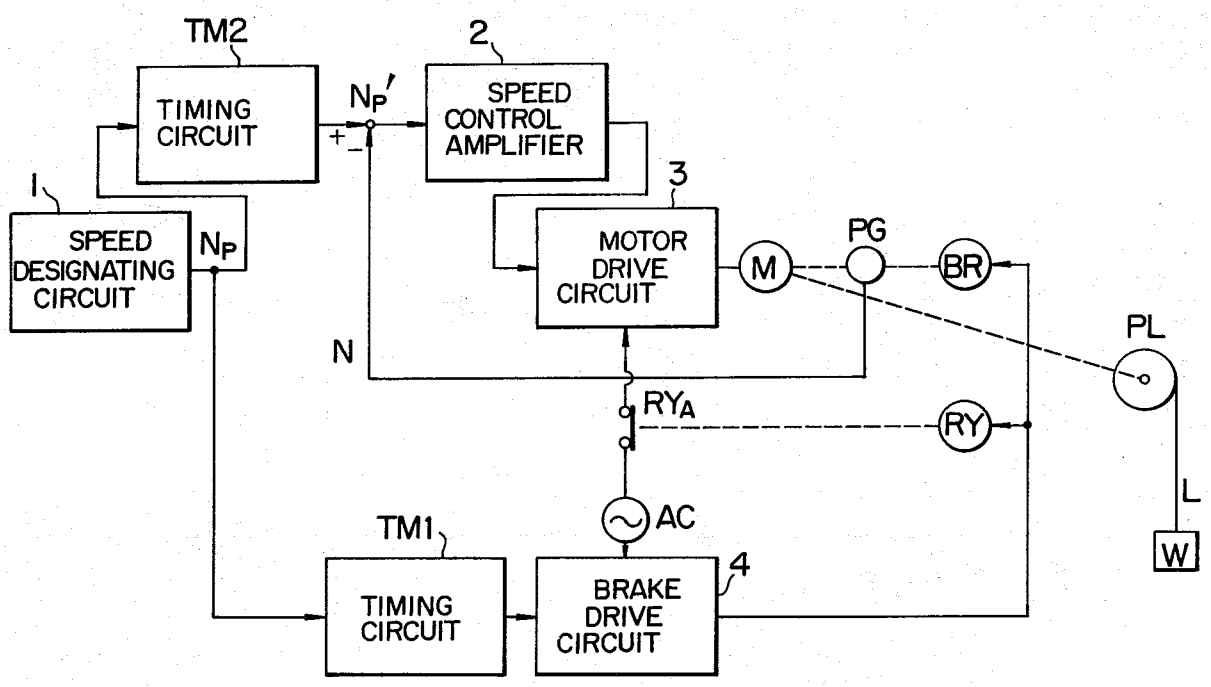
FIG. 1 is a schematic block diagram of the fundamental electric circuits of a moving apparatus embodying the invention.

In FIG. 1, there are shown a speed designating circuit 1, a speed control amplifier 2, a motor drive circuit 3, and a motor M in such a relationship that, if a designated speed sgnal Np is given by the designating circuit, a value equal to an actual designated-speed signal Np' will be input to the amplifier and then the motor will be driven by its drive circuit. The motor M is mechanically coupled to a speed detecting generator PG for detecting its rotational speed, a solenoid-controlled mechanical brake BR, and a pulley PL. A rope L is wound around the pulley PL and holds a load W with its hanging end. With these components the moving apparatus can lift or lower the load W to a desired height. The rotational speed of the motor M follows the designated speed signal Np from the speed designating circuit 1 as an actual speed signal N from the speed detecting generator PG is fed back to the input of the speed control amplifier 2. With the exception of the mechanical brake system, the circuitry of this control system is the same as that described in the aforesaid U.S. patent.

The mechanical brake BR for holding the load is disengaged or open when the designated speed signal Np is not zero speed, as the brake drive circuit 4 is energized by the same signal Np. Simultaneously with this, a relay RY is excited and its relay contacts KYA are closed, so that the motor drive circuit 3 is supplied with power current from an alternating-current source AC to lift or lower the load W in compliance with the designated speed signal Np. When the signal Np is for zero speed, the actual speed N of the motor M drops to zero and the output of the brake drive circuit 4 becomes zero, too. Consequently, the brake BR and relay RY are both de-energized, the relay contacts RYA are opened, and the driving force of the motor M is reduced to zero while, at the same time, the brake BR develops a sufficient braking force to hold the load W.

A timing circuit TM1 is provided which is a timer for imparting time constants for the rise and fall of the designated speed signal Np. It thus actuates the brake drive circuit 4 with a lag, by a time constant $T_{R1}$ for rise or by a time constant $T_{F1}$ for fall, behind the designated speed signal Np. Another timing circuit TM2 enables the actual designated-speed signal Np' to act with a lag, by a time constant $T_{R2}$ for rise or a time constant $T_{F2}$ for fall, behind the designated speed signal Np. Even if the designated speed signal Np is sharply varied, the timing circuit TM2 will not compel the mechanical system to conform to the signal Np but convert the signal to a moderate actual speed signal Np', so that the application of impact force to the mechanical system is avoided and the apparatus is started and stopped in a gentle way under adequate control. The rise time constant $T_{R2}$ and fall time constant $T_{F2}$ of the timing circuit TM2 desirably range from 0.2 to 0.5 second for practical purposes.

The timing circuits TM1 and TM2 are designed to have time constants $T_{R1}$, $T_{F1}$, $T_{R2}$ and $T_{F2}$ between which the following relations hold:

$$T_{R2} > T_{R1} \quad (1)$$

$$T_{F1} > T_{F2} \quad (2)$$

The time constant $T_{F1}$ is intentionally set to a value higher than the inertial time constant of the mechanical system during the period from the setting of the designated speed signal Np to zero till the load W comes to a stop.

Thus, at the time of starting, from the relation (1) it follows that the brake drive circuit 4 is actuated before the actual designated-speed signal Np' rises upon receipt of the designated speed signal Np so as to release the brake BR and supply AC power from the source AC to the motor drive circuit 3. Because the actual designated-speed signal Np' at that time is nearly zero, the speed control system holds the load W immediately upon the release of the brake BR. Soon the actual designated-speed signal Np' rises with the time constant $T_{R2}$ in response to the designated speed signal Np, and therefore the actual speed N of the motor M gradually increases to lift or lower the load W at the desired speed Np.

At the start, as described above, the speed control system holds the load W while the actual designated-speed signal Np' is practically zero simultaneously with the releasing of the mechanical brake BR, and then gradually the speed N rises. For this reason there is no possibility of the brake BR and motor M developing forces exclusive of each other, and smooth starting characteristic and good operability are obtained without the possibility of the brake BR being subjected to any excessive impact force.

During the course of stopping, from the relation (2), the introduction of the designated speed signal Np set to zero is followed by a gradual rise of the actual designated-speed signal Np' with the time constant $T_{F2}$, and the motor speed N is reduced to zero after a delay corresponding to the inertial time constant of the mechanical system. In this state the actual designated-speed signal Np' is for zero speed and the speed control system holds the load W. Thereafter, with the time constant $T_{F1}$ the input to the brake drive circuit 4 falls to zero, when the power supply from the source AC to the motor M is cut off. At the same time, the brake BR develops a braking force and holds the load W.

As stated, there is no danger of the mechanical brake being forcibly applied, when the mechanical system is still moving by inertia, in immediate response to a designated speed signal Np set to zero speed in the process of stopping. The start and stop of the motor M and the opening and closing motions of the brake BR are accomplished when the actual speed N has dropped to zero. This precludes any undue variation in the impact energy applicable to the brake BR and mechanical system. Therefore, the braking capacity of the mechanical brake has only to be sufficient for suspending and holding the load W in the air. Also, the start and stop motions are smoothly carried out with extremely satisfactory controllability. In addition, because the power supply from the source AC is cut off as soon as the mechanical brake BR develops the necessary braking force, the power consumption is small and an apparatus of a power-saving type is provided.

Figure 2:
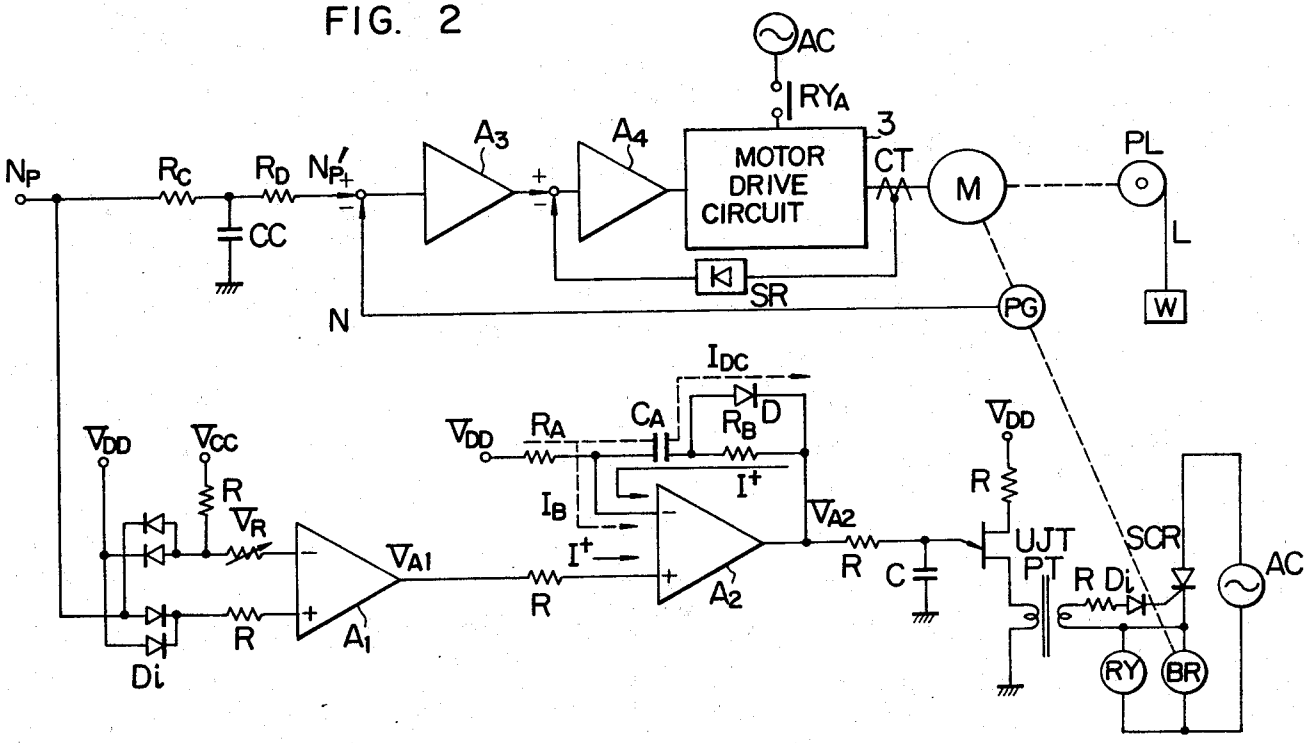
FIG. 2 is a detailed circuit diagram of the electric circuits of the embodiment.

Next, a typical example of circuitry according to the invention will be described in connection with FIG. 2. As a general construction, an operational amplifier A3 constitutes a speed control system as it is supplied with a feedback signal of the actual speed N from the speed detecting generator PG and a designated speed signal Np converted to an actual designated-speed signal Np' through a T-type CR circuit forming a timing circuit TM2. Another operational amplifier A4 is adapted to receive as its input a signal from a current transformer CT that detects the current in the motor M, the signal being rectified by a rectifier SR. A Norton operational amplifier A1 is an inverting circuit for always converting the input of designated speed signal Np to a positive output. Another Norton operational amplifier A2 constitutes a timing circuit TM1. The output of the timing circuit TM1 is input to a phase control circuit for opening and closing a thyristor SCR, the latter circuit comprising a uninjection transistor UJT, a capacitor C, and fixed resistors R. As the thyristor SCR is energized, the brake BR is actuated and opened, and an AC power is fed from the source AC to the motor drive circuit 3 via the relay RY. This is reversed when the thyristor SCR is made nonconductive.

Figure 4:
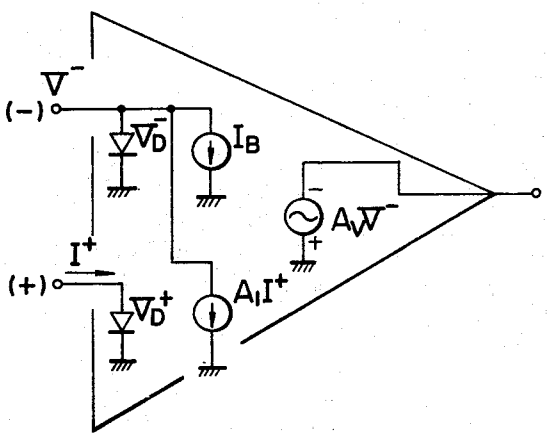
FIG. 4 is a connection diagram of an equivalent circuit of the arrangement shown in FIG. 3.
Figure 3:
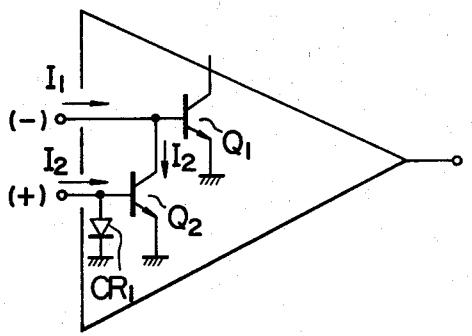
FIG. 3 is a connection diagram of the input region of a Norton differential amplifier.

The Norton operational amplifier that forms the essential part of the timing circuit TM1 is of a current-operated type. Instead of using a differential-amplifying transistor in the input region, a mirror circuit is formed, as shown in FIG. 3, which acts so that the noninverted input deduces a current equal to its input current from the current that is applied to the inverted input terminal (−). To be more exact, the Norton operational amplifier is made of a mirror circuit comprising transistors $Q_1$, $Q_2$ which deduce only the noninverted input current $I_2$ from the current $I_1$ applied to its inverted input terminal (−). Its equivalent circuit is shown in FIG. 4, where the current amplification factor $A_I$ is 1, and a current $I^+$ is flown to the noninverted input terminal (+), and the current $I^+$ and a bias current $I_B$ of the transistor $Q_1$ are flown to the inverted input terminal (−). The output is equal to the input voltage multiplied by the voltage amplification factor $A_V$.

The time constants of the timing circuit TM2 comprising the T-type CR circuit, resistors $R_C$, $R_D$, and a capacitor $C_C$ are, for both rise and fall, $T_{R2} = T_{F2} = C_C \cdot C_C$.

The timing circuit TM1 is such that, when a positive voltage is applied to the input voltage $A_{A1}$ from the Norton operational amplifier A1, a current $I^+$ flows into the non-inverted input terminal and current $I^+$ indicated by a full line flows through a feedback impedance connected from the output terminal to the inverted input terminal, that is, through a resistor $R_B$ and a capacitor $C_A$, and the capacitor $C_A$ is charged. Therefore, the output voltage $V_{A2}$ of the Norton operational amplifier A2 rises with a time constant $T_{R1} = C_A \cdot R_B$. Next, when the input $V_{A1}$ falls to zero, a current $I_{DC}$ represented by a dashed line flows from a direct-current source $V_{DD}$ through a resistor $R_A$, a capacitor $C_A$, and a diode D, whereby the capacitor $C_A$ is discharged. As a result, the output voltage $V_{A2}$ rises with a time constant $T_{F2} = C_A \cdot R_A$. Hence the constants of the timing circuits may be chosen from the relations (1) and (2) to be as follows:

$$C_C \cdot R_C > C_A \cdot R_B \quad (3)$$

$$C_A \cdot R_A > C_C \cdot R_C \quad (4)$$

Here it is noted that the $C_A \cdot R_A$ must be chosen to be a value greater than the mechanical inertial time constant for the reason already explained.

Figure 5:
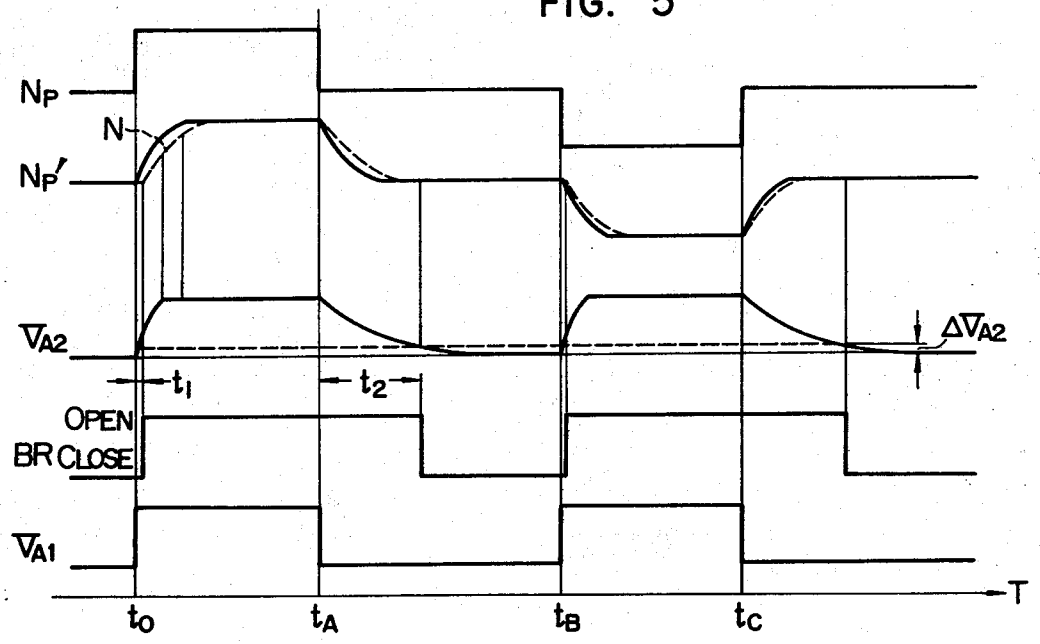
FIG. 5 is a graphic representation of the electric circuits of FIG. 2 in action.

The operation of the arrangement of FIG. 2 will be generally explained with reference to FIG. 5.

If the designated speed signal Np rises in a time $t_0$ in the lifting direction, the actual designated-speed signal Np' will rise with a lag by a time constant $T_{R2} = C_C \cdot R_C$ and, at the same time, the output of the timing circuit TMl will rise with a time constant $T_{R1} = C_A \cdot R_B$. From the relation (1), the output $V_{A2}$ rises faster. Therefore, the brake BR is opened after a time $t_1$ when the output $V_{A2}$ reaches a threshold $\Delta V_{A2}$ that is enough to energize the thyristor SCR, and the actual designated-speed signal Np' gradually rises from zero. Next, when the designated speed signal Np rises in a time $t_A$ as a stop signal, the actual designated-speed signal Np' will rise with a lag by the time constant $T_{F2} = C_C \cdot R_C$ and, at the same time, the output $V_{A2}$ of the timing circuit TMl will fall with the time constant $T_{Fl} = C_A \cdot R_A$. From the relation (2), when the actual designated-speed signal Np' has reached zero and the actual speed N has dropped to zero with a lag by the time constant of mechanical inertia, the output $V_{A2}$ in a time $t_2$ will drop below the sufficient value $\Delta V_{A2}$ to de-energize the thyristor SCR, thus closing the brake BR and applying a braking force. The same applies to the lowering of load in a time $t_B - t_C$.

While a preferred embodiment of the invention has been described as using electric circuits as timing means, it should not be taken as a limitation; as will be obvious to those skilled in the art, mechanical delay elements or the like may be employed as well for the same purposes.

According to the present invention, as has been described hereinabove, a moving apparatus for a load is provided which has speed contol means, with a timing device for actuating a mechanical brake lagging in rise from a designated speed signal, so that the closing motion of the brake is effected when the actual speed of the mechanical system, such as of the load, has been reduced to zero and therefore the brake is protected from any excessive impact force due to the inertial energy of the mechanical system. As a result, the life of the mechanical brake is extended. Moreover, because it is required to have a braking capacity only enough to suspend and hold the load in the air, the brake can be reduced in size, made highly reliable, and made available at low cost. The stopping motion is smooth and objectionable sway of the load is avoided with consequent improvements in controllability and safety of the apparatus.

In addition to the said first timing device (incorporated in the brake control system), a second timing device may be located between the speed designating means and the speed control means, in such a manner that the rise motion of the second timing device lags behind that of the first timing device and the fall motion of the first timing device lags behind that of the second device. This arrangement eliminates forces that would otherwise act on the mechanical brake and drives exclusively of each other at the time of starting or stopping the apparatus. Hence, the starting and stopping of the apparatus can be smoothly carried out and its operability and safety are furhter improved.

Furthermore, because the power supply to the motor is cut off immediately upon the actuation of the mechanical brake, the power consumption is accordingly reduced and a power-saving moving apparatus for a load can be provided. In case of a stoppage of power supply, the mechanical brake that has nothing to do with electricity will hold the load without the danger of any unintended drop.

What is claimed is:

1. A moving apparatus for moving a load comprising lift meand for lifting the load, drive means for driving said lift means, driving-force control means for energizing said drive means, speed control means for controlling the output energy of said driving-force control means in response to designated speed signals from speed designator means, speed detector means for detecting the speed at which the load is lifted or lowered, brake means for holding the load with a mechanical braking force, brake drive means for energizing said brake means, and brake control means for controlling the output energy of said brake drive means in response to speed designating signals from said speed designator means, said brake control means incorporating a first timing means for actuating said brake means with a lag in response to a designated speed signal for zero speed; further comprising a second timing means, interposed between said speed designation means and said speed control means, for imparting a time lag to the rise and fall times of the designated speed signals, wherein the rise motion of the second timing means lags behind that of the first timing means at the rise of the designated speed signal and the fall motion of said first timing means lags behind that of the second timing means at the fall of the designated speed signal for zero speed.

* * * * *